United States Patent [19]

Mally et al.

[11] Patent Number: 4,532,751

[45] Date of Patent: Aug. 6, 1985

[54] AUTOMATIC SHEET PRODUCT LINE

[75] Inventors: Timothy G. Mally, Oregon; James A. Rattmann, Sun Prairie; Alvin Borsuk, Madison, all of Wis.

[73] Assignee: Oscar Mayer Foods Corp., Madison, Wis.

[21] Appl. No.: 600,702

[22] Filed: Apr. 16, 1984

[51] Int. Cl.[3] ..... B26D 5/00; B26D 7/28

[52] U.S. Cl. ..... 53/396; 53/73; 53/74; 53/389; 53/435; 53/517; 83/205; 83/285

[58] Field of Search ..... 53/64, 66, 73, 76, 396, 53/389, 517, 767, 157, 74; 83/203, 205, 155, 23, 37, 92, 285

[56] References Cited

U.S. PATENT DOCUMENTS 2,888,793 6/1959 Folk ..... 53/317 X
3,053,128 9/1962 Manthay ..... 83/205 X
3,540,187 11/1970 Monaghan ..... 53/66 X
3,846,958 11/1974 Divan ..... 53/517 X

*Primary Examiner*—James M. Meister
*Attorney, Agent, or Firm*—Joseph T. Harcarik; Thomas R. Savoie; Daniel J. Donovan

[57] ABSTRACT

A product line is provided for forming a sheet product composed of products such as bacon slices resting on a pre-cut thin substrate such as a sheet of paper. The substrate sheets are pre-cut to a predetermined length, and a flow of individual products and a flow of pre-cut sheets are coordinated such that the products deposit onto the pre-cut sheets in a predetermined pattern. The line may also include an assembly for reducing the flow rate of the thus formed sheet products, after which the reduced flow is conveyed to a stacking assembly for forming stacks of sheet products of a preselected size.

28 Claims, 7 Drawing Figures

AUTOMATIC SHEET PRODUCT LINE

DESCRIPTION

Figure 1:
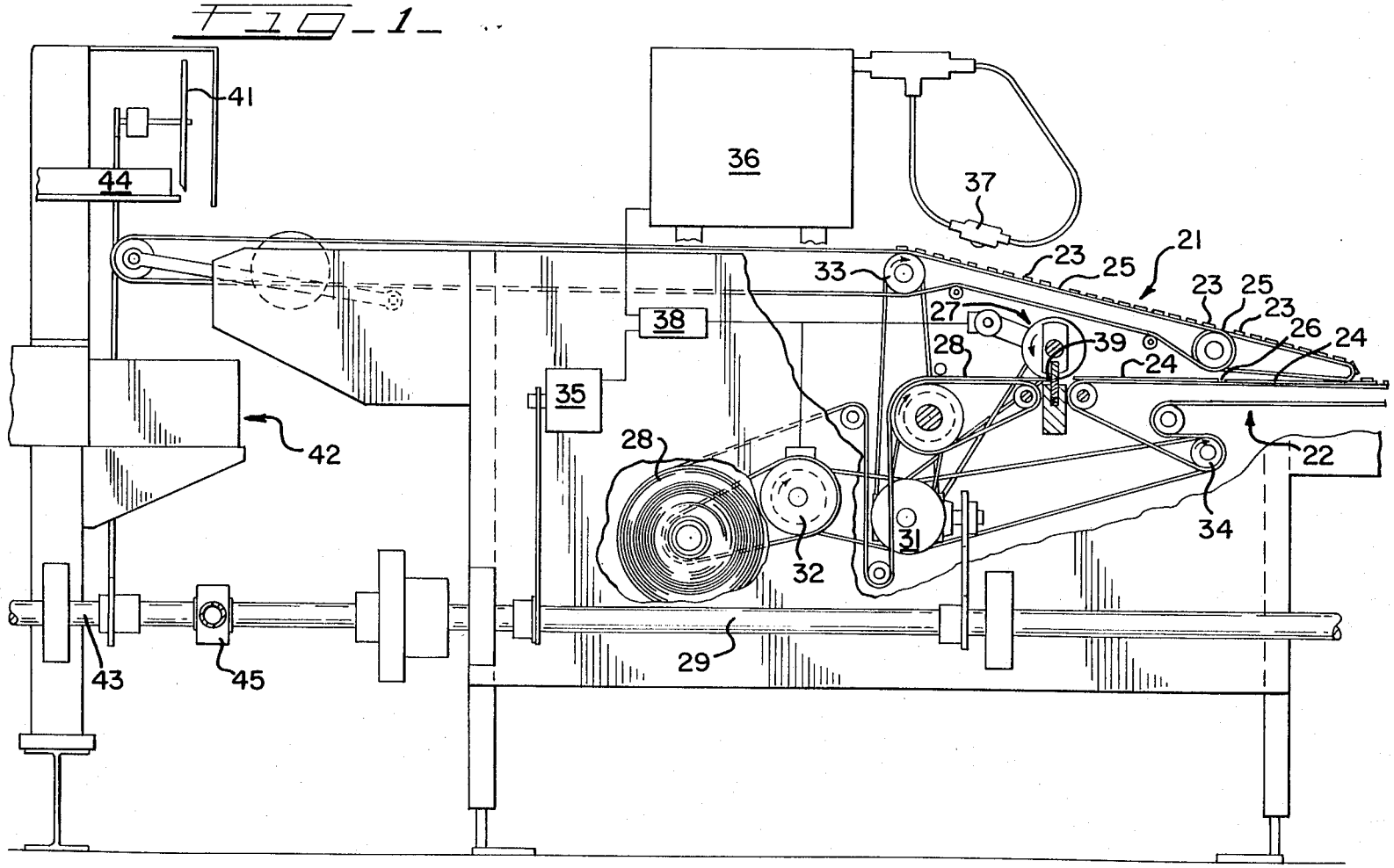

This invention generally relates to an apparatus and method for forming and stacking products, more particularly, to an apparatus and method wherein a plurality of items are deposited onto a pre-cut length of substrate in order to form a sheet product, after which a plurality of such sheet products are, if desired, formed into a stack of sheet products. The invention is particularly suitable for use in conjunction with the assembly and stacking of sheet products composed of bacon slices deposited onto a packaging substrate such as a sheet of paper or the like.

Equipment is available for use on bacon packaging lines and the like, which equipment includes or operates in conjunction with a slicing mechanism such that slices are deposited onto a continuous web of paper or the like, after which the continuous web is severed, either by hand or by a paper slicing fixture of the apparatus. With these prior approaches, the substrate is severed at a location between the individual slices that are positioned thereon. When this task is performed manually, it requires a worker of exceptional skill who can rapidly select the proper severance location and make the required cut while the web is being conveyed past such a worker.

When the substrate severing is carried out by a severing device positioned along the web of substrate and slices resting thereon, it is especially difficult to maintain the timing needed whereby the line of severance will consistently be made at the appropriate location. It is especially difficult for these types of mechanical severance devices to monitor the flow of slices onto the continuous substrate web and to make adjustments as needed to have the cutting device sever the substrate at the proper location. The proper location is one at which there is a gap between slices and where the severing device cuts through only the substrate. On occasion, the desired timing sequence between the formation of these gaps and the cutting orientation of the severing device is not adhered to, and the severing device engages the slices resting on the substrate, which results in damage to the slices and often the formation of a meat film or the like on the severing device to thereby reduce its cutting efficiency.

Additionally, these previously known systems typically rely upon manually operated or manually assisted stacking operations when there is a need to stack the thus formed sheet products. Such stacking operations are generally labor intensive and/or can lead to delay of upstream operations such as the previously discussed formation of sheet products at those times that these manually operated or manually assisted stacking operations cannot keep pace with such upstream operations.

The present invention includes a method and apparatus that provides a pre-cut length of paper or other substrate and that deposits individual products in timed sequence on such pre-cut length of substrate in order to form a sheet product having a predetermined number of individual products resting on the length of substrate. These sheet products are formed by conveying a flow of products such as bacon slices, monitoring the flow of products whereby the flow of products coincides with the cutting and delivering of the pre-cut substrate or sheet to a conveyed location at which the products will be deposited onto the pre-cut sheet, with the flow of products having gaps at locations that generally coincide with locations where the sheet has been pre-cut. When desired, the sheet products thus formed are subsequently formed into stacks of sheet products, the preferred stacking apparatus and method carrying out a reduction in the flow rate of sheet product units and automatically mechanically forming these sheet product units into a stack having a plurality of sheet products.

It is accordingly a general object of the present invention to provide an improved apparatus and method for forming sheet products whereby a flow of products is deposited onto a pre-cut substrate.

Another object of the present invention is to provide an improved sheet product forming apparatus and method whereby a flow of individual products is monitored and provides input to controls for providing a predetermined length of substrate and delivering that substrate length to a conveyed pathway that is aligned for the deposit of a group of products thereonto.

Another object of this invention is to provide an improved apparatus and method whereby sheet products are monitored during their formation in order to provide input to a downstream stacking assembly to insure that only generally complete sheet products are stacked thereby.

Another object of the present invention is to provide an improved apparatus and method for automatically forming and stacking sheet products consisting of pre-cut substrates and a plurality of products deposited thereon.

Another object of this invention is to provide an improved apparatus and method for depositing bacon slices onto a packing substrate of a pre-cut length and automatically stacking the sheet products thus formed.

Figure 3A:
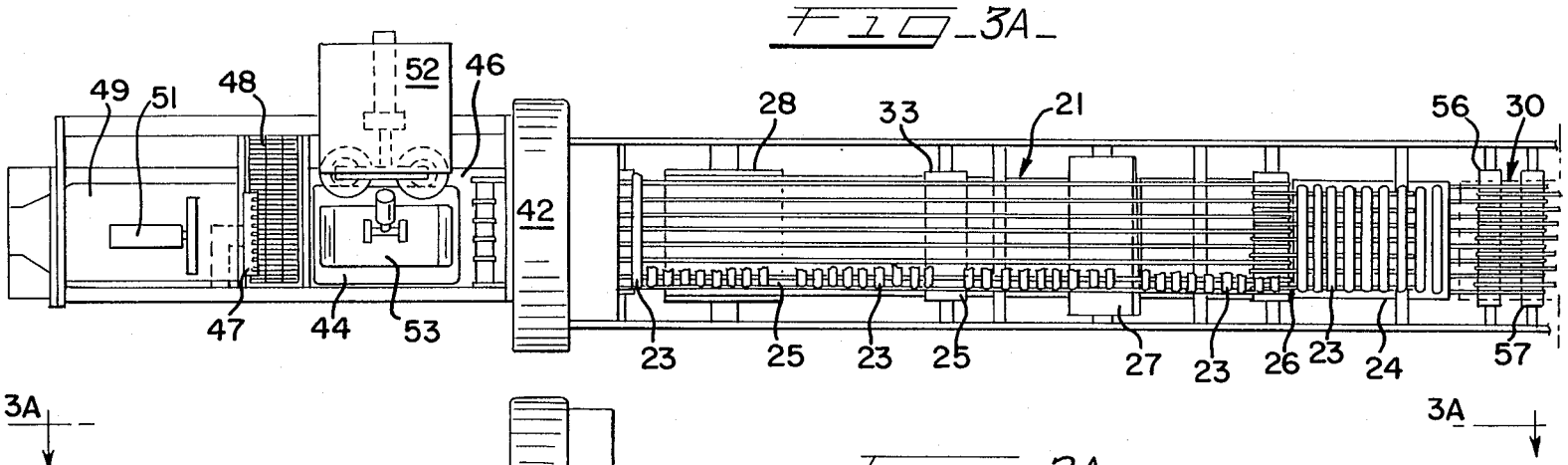
Figure 2A:
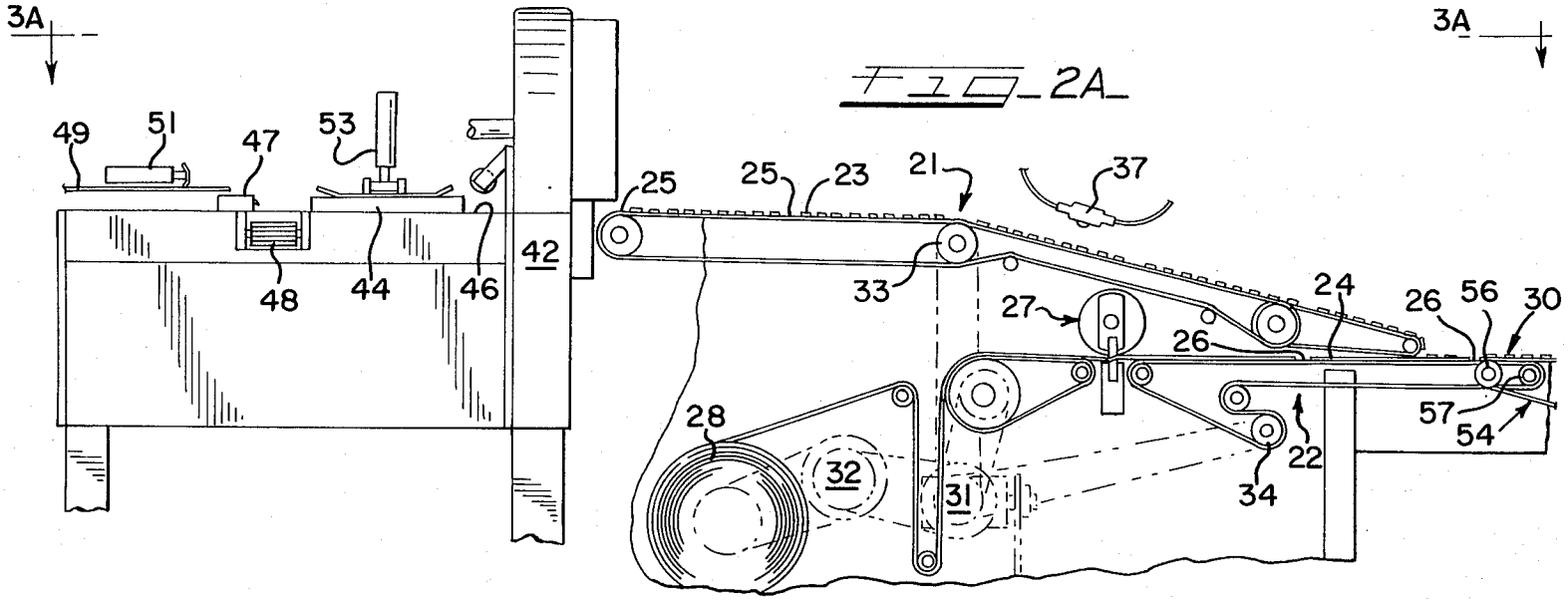
Figure 3B:
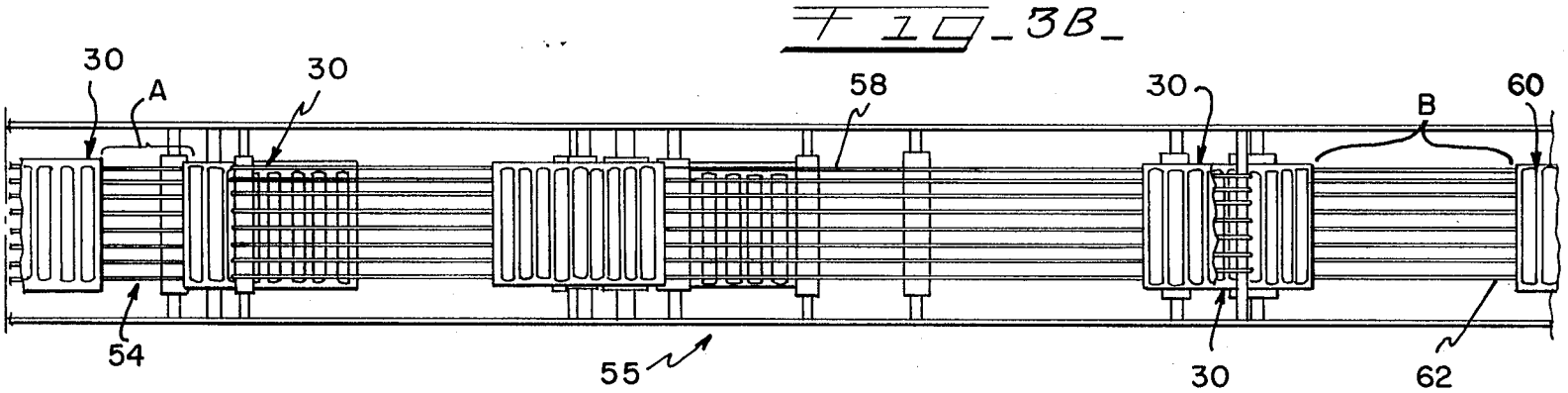
Figure 2B:
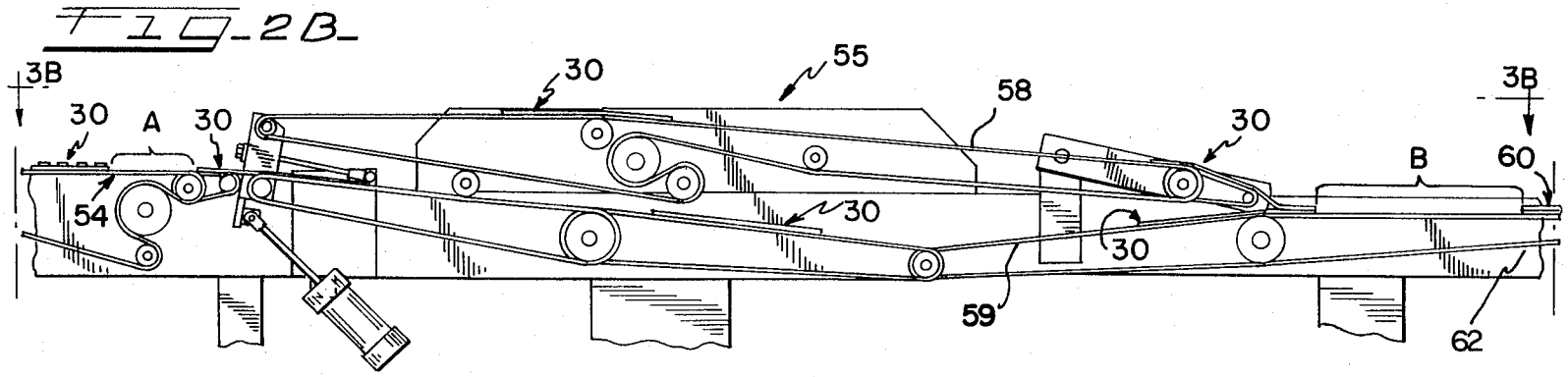
Figure 3C:
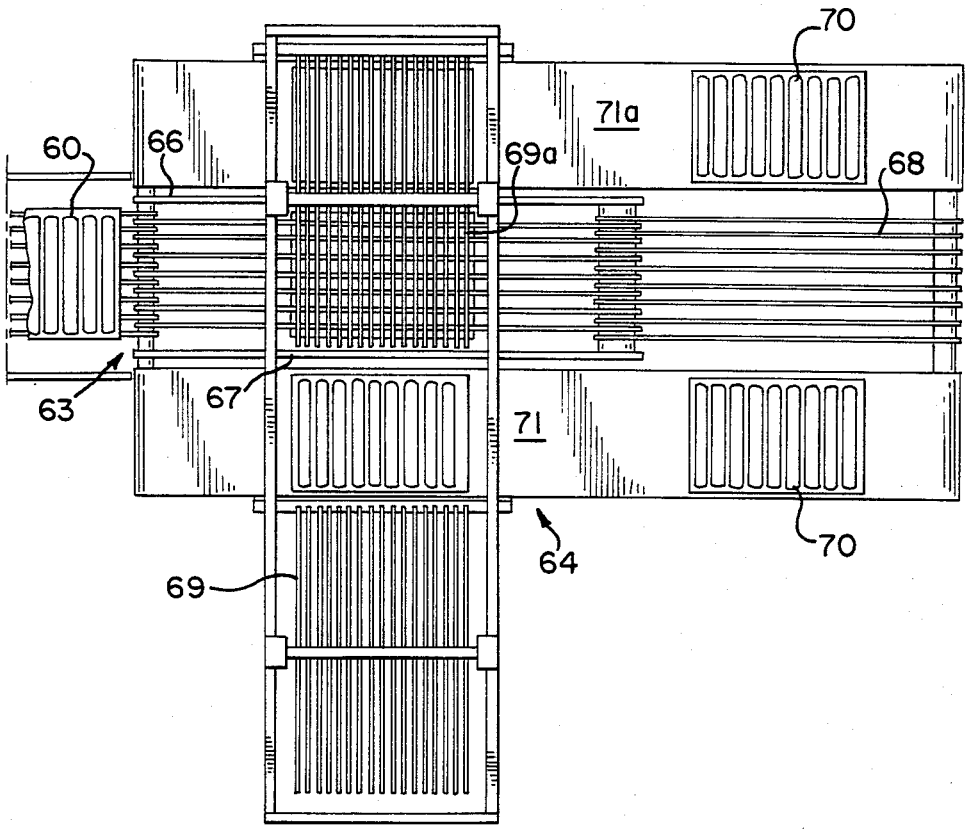
Figure 2C:
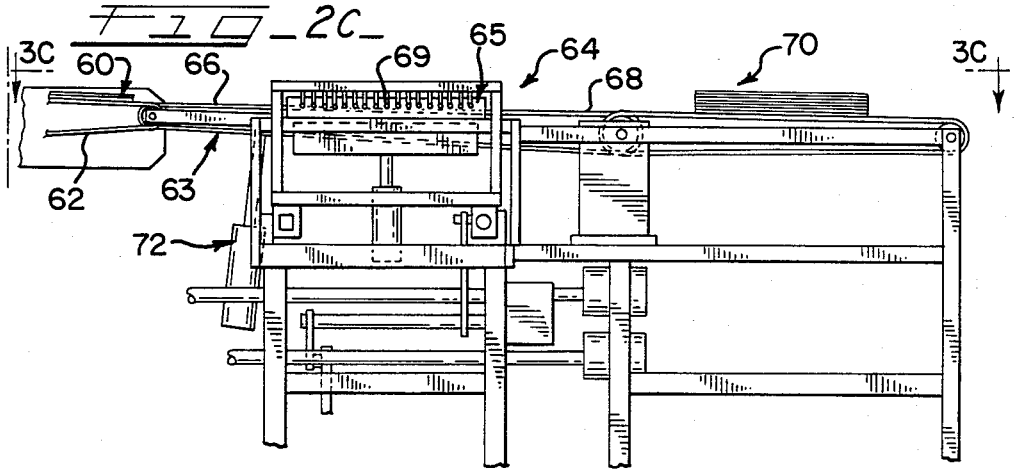

These and other objects of the present invention will be apparent from the following description of this invention, taken in conjunction with the accompanying drawings, wherein:

FIG. 1 is an illustration of the preferred apparatus according to this invention for forming a flow of sheet products;

FIGS. 2A, 2B and 2C combine to provide an elevational view of the preferred embodiment of the sheet product formation and stacking system according to this invention; and FIGS. 3A, 3B and 3C combine to provide a top plan view of the system illustrated in FIGS. 2A, 2B and 2C.

The sheet product formation device illustrated in FIG. 1 includes a product conveyor assembly, generally designated as 21, which operatively intersects a substrate supply assembly, generally designated as 22. Individual products 23, such as bacon slices, are deposited by the product conveyor assembly 21 onto pre-cut lengths of substrate 24, such as paper from the substrate supply assembly 22, in order to form sheet products 30. Gaps 25 are provided between products 23 which generally coincide with severance gaps 26 between the pre-cut lengths of substrate 24. A cutter assembly 27 is provided to form the pre-cut lengths of substrate 24 from a substrate web 28, such as the illustrated paper roll.

A drive assembly is provided for driving the product conveyor assembly 21 and the substrate supply assembly 22 at the same speed. The drive assembly illustrated includes a line shaft 29 that drives a gear box 31 or the like, which in turn drives a substrate web drive assembly 32, a drive roller 33 of the product conveyor assembly 21, and a drive roller 34 of the pre-cut substrate supply assembly 22. A rotary cam switch 35 or the like is also in driven communication with the line shaft 29.

A detector assembly 36 having an "electric eye" or photocell device 37 is provided for detecting the presence of products 23 on the product conveyor assembly 21. The detector assembly 36 is suitably adjusted to signal when one or more products 23 have passed under the photocell device 37, at which time a signal is transmitted to a programable controller or similar device 38. This signal is referred to herein as the "product coming" signal.

Rotation of line shaft 29 correspondingly rotates the rotary cam switch 35 in order to provide a further signal to the controller 38. This signal is referred to herein as a "gap" signal. When the controller 38 receives both the "product coming" signal and the "gap" signal, the controller 38 provides a signal to the substrate web drive assembly 32 to feed the substrate to the cutter assembly 27, as well as a signal to the cutter assembly 27 to sever the thus fed substrate web 28. As a result, the pre-cut substrate length 24 is delivered onto the substrate supply assembly 22 in alignment with a grouping of products 23 being conveyed along the product conveyor assembly 21. Preferably, the cutter assembly 27 includes an elongated cutting edge 39 that rotates at a predetermined speed, and the signal from the controller 38 accomplishes a dropping of the rotating elongated cutting edge 39 to its severing orientation.

In the preferred embodiment of this invention, rotation of the line shaft 29 and the rotary cam switch 35 is mechanically in time with rotation of a slicing blade 41 of a slicer assembly generally designated as 42. As illustrated in FIG. 1, the slicer assembly 42 includes a drive shaft 43 which is in driving engagement with the slicing blade 41 and the line shaft 29. Preferably, the slicer assembly 42 is of the hesitating type by which the slicing blade 41, by known means, intermittently does not slice a bulk product 44, such as a pork belly, that is being fed to the slicing blade 41. The slicer assembly 42 "hesitates" in a predetermined sequence in order to form a gap such as the gap 25 between individual products 23 as illustrated. In the illustrated embodiment, this hesitation occurs every tenth rotation of the slicing blade 41, whereby the product deposited onto the product conveyor assembly 21 consists of nine sliced products 23, a gap 25 which is substantially the same size as a single product 23, followed by another nine sliced products 23, and so forth. The slicer assembly 42 may be adjusted to provide other patterns of products and gaps, as desired.

In accordance with the present invention, the rotary cam switch 35 is mechanically in time with the pattern of product slices and gaps developed by the slicer assembly 42. By way of example, when the slicer assembly 42 is adjusted to provide a pattern of nine product slices 23 followed by a single gap 25, the correlation among the various components is selected such that, for every ten full rotations of the slicing blade 41, the line shaft rotates one time, thereby rotating the rotary cam switch 35 one time. The single rotation of the rotary cam switch 35 provides the "gap" signal to the controller 38. Provided the controller 38 also receives the "product coming" signal from the detector assembly 36, then the cutter assembly 27 will move into cutting position and the substrate web 28 will be fed in order to provide the pre-cut substrate length 24 onto the substrate supply assembly 22 in timed sequence with a group of nine product slices 23 on the product conveyor assembly 21 such that the product slices 23 deposit on the pre-cut substrate length 24 and such that the gaps 25 before and after the product slices 23 coincide with the severance gaps 26 before and after the pre-cut length 24. A phase adjuster 45 may be provided in order to "fine tune" the relationship between the rotation of the slicing blade 41 and the rotation of the line shaft 29. Phase adjuster 45 is of known construction and can accomplish this fine tuning while the components are in operation.

In the embodiment illustrated in FIGS. 2A and 3A, the slicer assembly 42 is associated with a slicer feed mechanism which includes a support assembly 46, which is a primary support for and feed path of the bulk product 44 such as a bacon belly. A movable gripper assembly 47 is provided for gripping the bulk product 44, for pushing same to and through the slicing blade 41, and for retracting a butt portion of the bulk product 44 to a conveyor assembly 48. A slideable shelf assembly 49 is spaced above and is generally parallel to the support assembly 46. A rear pusher assembly 51 is positioned along the slideable shelf assembly for removal of a bulk product 44 from the slideable shelf assembly 49 when same retracts in the upstream direction, after which the bulk product 44 falls onto the support assembly 46.

Proper alignment of the thus dropped bulk product 44 with respect to the slicing blade 41 can be achieved by providing a pusher assembly 52 to horizontally align the product and a hold-down assembly 53 to ensure that the product 44 is vertically aligned. Further details of this slicer feed mechanism are found in the copending application of James A. Rattmann, entitled "Slicer Feed Mechanism", Ser. No. 588,267, filed Mar. 13, 1984, the subject matter thereof being incorporated by reference hereinto.

With reference to FIGS. 2A–2B and 3A–3B, the pre-cut substrate supply assembly 22 is in overlapping conveyed relationship with a feed conveyor 54 which conveys the sheet products 30 to a conveyor flow reducer, generally designated as 55. The feed conveyor 54 has a conveying speed that is greater than the conveyed feed rate of the substrate supply assembly 22, as a result of which, the conveyed speed of each sheet product 30 is increased while it passes over overlap rollers 56, 57. This increase in conveyed speed increases the size of the gap 26 to spacing A illustrated in FIGS. 2B and 3B. Spacing A provides an adequate delay between sheet products 30 that are fed by the feed conveyor 54 onto the conveyor flow reducer 55.

Conveyor flow reducer 55 deposits one sheet product 30 on top of another sheet product 30 in order to form a flow of intermediate product stacks 60 having a spacing B therebetween. Spacing B is substantially greater than spacing A. The result is that the conveyor flow reducer 55 increases the spacing between conveyed product units while it reduces by one-half the number of product units that need to be handled downstream of the conveyor flow reducer 55 in order to provide product units in a conveyed pattern that is more easily handled by a downstream station than the conveyed pattern of sheet products 30 and spacings A that is upstream of the conveyor flow reducer 55. In effect, the conveyor flow reducer 55 reduces the flow rate of the sheet products 30.

The conveyor flow reducer 55 includes an upper conveyor tier 58, a lower conveyor tier 59, and a diverter assembly 61 by which sheet products 30 are alternately fed onto the lower conveyor tier 59 and then the upper conveyor tier 58. Lower conveyor tier 59 conveys intermittently and includes a stopped mode. Upper conveyor tier 58 has a substantially constant conveying rate, as a result of which sheet products 30 being conveyed by the upper conveyor tier 58 overtake sheet products 30 on the lower conveyor tier 59. This movement of the upper conveyor tier 58 and of the lower conveyor tier 59 is synchronized such that a sheet product 30 leaving the upper conveyor tier 58 is deposited onto and into generally aligned relationship with a corresponding sheet product 30 while it is being conveyed by the lower conveyor tier 59, thereby forming the intermediate product stack 60. Further details regarding the illustrated, preferred conveyor flow reducer 55 can be found in the copending application of James A. Rattmann and Timothy G. Mally, entitled "Conveyor Flow Reducer", Ser. No. 588,266, filed Mar. 12, 1984, the subject matter of which is incorporated by reference hereinto.

Referring now to FIGS. 2C and 3C, the lower conveyor tier 59 of the conveyor flow reducer 55 extends into a downstream transport conveyor 62, which in turn includes an extension conveyor assembly 63 of a stacker assembly, generally designated as 64. Preferably, the lower conveyor tier 59, the downstream transport conveyor 62, and the extension conveyor assembly 63 run in unison such that each stops and starts at the same times, and each conveys at the same times and at the same rates. Stacker assembly 64 forms the intermediate product stacks 60 into completed product stacks 70. Stacker assembly 64 has a handling capacity that is adequate to form the completed stacks 70 from the conveyed flow of intermittent product stacks 60 at spacings B. Stacker assembly 64 includes a lifter assembly 65, the operation of which requires input from the detector assembly 36 positioned above the product conveyor assembly 21 (FIGS. 1 and 2A).

A better understanding of the operational interrelationship between the detector assembly 36 and the lifter assembly 65 of the stacker assembly 64 can be obtained by considering this interrelationship in the context of the illustrated embodiment of the stacker assembly 64. This illustrated embodiment of the stacker assembly 64 is the subject of a copending application of Alvin Borsuk, Timothy G. Mally and James A. Rattmann, entitled "Stacker Assembly", the subject matter thereof being incorporated by reference hereinto.

The extension conveyor assembly 63 of the illustrated stacker assembly 64 includes an on-feed portion 66, a transfer portion 67, and a pass-through portion 68. The lifter assembly 65 raises intermediate product stack 60 off of the transfer portion 67 to a height above the top surface of a comb assembly 69, after which the comb assembly 69 moves under the intermediate product stack and the lifter assembly 65 drops, whereby the intermediate product stack 60 is deposited onto the comb assembly 69. Thereafter, comb assembly 69 moves the intermediate product stack 60 to a location above a discharge conveyor 71 for deposit thereonto or onto a previously deposited intermediate product stack 60. Preferably, as illustrated, a second comb assembly **69*a* and a second discharge conveyor 71*a* are provided in order to substantially double the handling capacity of the stacker assembly 64**.

Lifter assembly 65 is raised at the time that the extension conveyor assembly 63 has stopped and only when an acceptable intermediate product stack 60 is positioned on the transfer portion 67 thereof, which is immediately above the lifter assembly 65. A determination that an acceptable intermediate product stack 60 is positioned on the transfer portion is made from signals previously generated upstream of the transfer portion 67. At the time that the photocell device 37 (FIG. 1 and FIG. 2A) has "seen" one or more individual products 23 on the product conveyor assembly 21, an appropriate signal is stored, for example, in the programable controller 38 (FIG. 1). This is the previously described "product coming" signal. After an appropriate delay to account for the time needed to convey the products 23 from a location at the photocell device 37 to the location of the transfer portion 67 of the stacker assembly 64, the programable controller 38 will signal for lifting of the lifter assembly 65, provided a second signal is also received.

This second signal is generated in association with oscillating movement of the comb assemblies 69, **69*a*, such second signal being generated when both of the comb assemblies 69, 69*a* are clear of the transfer portion 67, while one of them is about to move thereover. In effect, the signal generated at the photocell device 37 informs the controller 38 that an acceptable product is on its way to the transfer portion 67 and that the lifter assembly 65 can be raised, provided the second signal is received to indicate that the comb assemblies 69, 69*a*** are correctly positioned.

If either the first signal or the second signal is not received by the controller 38, the lifter assembly 65 will not be raised when the transfer portion 67 stops, as a result of which any item on the transfer portion 67 at that time will subsequently be conveyed to the pass-through portion 68. Such an item may be, for example, an incomplete sheet product which has fewer than a preselected number of products 23, as determined by the detector assembly 36.

While the completed product stacks 70 are being formed, the discharge conveyors 71, **71*a* drop by operation of a lift assembly 72 in order to accommodate additional intermediate product stacks 60 until such time as a completed product stack 70 is formed. Once a completed product stock 70 is formed, the respective discharge conveyor 71 or 71*a* conveys the completed product stack 70** to a location for packaging or further processing.

It is to be appreciated that this invention can be embodied in various forms and therefore is to be construed and limited only the scope of the appended claims.

We claim:

1. An apparatus for automatically forming and stacking sheet products, comprising:

means for feeding a substrate web to a cutter assembly;

means for providing a conveyed flow of products having a preselected spacing pattern including a gap between a grouping of said products;

means for monitoring said conveyed flow of products and for signaling said cutter assembly to sever the substrate web to a pre-cut substrate length defined by severance gaps and to provide the pre-cut substrate length to a substrate supply assembly in timed sequence with said conveyed product flow means;

an intersection at which said substrate supply assembly operatively intersects with said conveyed product flow means, and said timed sequence being such that said grouping of products from the conveyed product flow means is deposited onto said pre-cut substrate length and such that said gap of the preselected spacing pattern generally coincides with one of said severance gaps, thereby forming a sheet product;

means for conveying a flow of said sheet products from said intersection of the substrate supply assembly and the conveyed product flow means;

means for reducing the rate of said flow of sheet products; and means for stacking the reduced rate flow of sheet products into a stack of a plurality of sheet products.

2. The apparatus according to claim 1, wherein said monitoring means provides a signal for initiating stacking of the sheet product at said stacking means.

3. The apparatus of claim 1, further including a drive assembly that synchronously drives said conveyed product flow means, said substrate supply assembly and switch means for providing a gap signal when said means for providing products defines said gap, wherein said monitoring means provides a product coming signal in response to the presence of said products on the conveyed product flow means, and wherein said gap signal and said product coming signal combine to command said providing of the pre-cut substrate length in timed sequence with said conveyed product flow means.

4. The apparatus according to claim 3, wherein said means for providing a conveyed flow of products includes a slicer assembly having drive means for slicing a bulk product into said conveyed flow of products and for driving said drive assembly.

5. The apparatus according to claim 1, wherein said means for providing a conveyed flow of products includes a slicer assembly having a slicer feed mechanism that includes a bulk product support assembly in alignment with a slicing blade, a slidable shelf assembly spaced above and generally parallel to said support assembly, and means for moving a bulk product from said slidable shelf assembly onto said support assembly.

6. The apparatus according to claim 1, wherein said flow rate reducing means deposits one of said sheet products onto another of said sheet products to form an intermediate product stack, said flow rate reducing means providing a flow of said intermediate product stacks having a spacing between intermediate product stacks that is substantially greater than spacing between sheet products upstream of said flow rate reducing means.

7. The apparatus according to claim 6, wherein said flow rate reducing means includes an upper conveyor tier, a lower conveyor tier and diverter means for feeding sheet products alternately to said upper conveyor tier and said lower conveyor tier, and wherein said upper conveyor tier carries out the deposit of one of said sheet products onto another of said sheet products that is conveyed by said lower conveyor tier.

8. The apparatus according to claim 1, wherein said flow rate reducing means includes a conveyor tier that extends to and that conveys substantially simultaneously with an extension conveyor assembly of said stacking means.

9. The apparatus according to claim 1, wherein said stacking means includes lifter means for raising a reduced flow rate sheet product in response to a control signal having an input signal from said monitoring means.

10. The apparatus according to claim 1, wherein said stacking means includes laterally oscillating comb assemblies having an oscillation position at which the comb assemblies are clear of an extension conveyor between the flow rate reducing means and the stacking means, and wherein said stacking means includes lifter means for raising a reduced flow rate sheet product in response to a control signal having an input signal generated when the comb assemblies are at said clear oscillation position.

11. The apparatus according to claim 10, wherein said control signal further includes an input signal from said monitoring means.

12. An apparatus for automatically forming sheet products, comprising:

means for feeding a substrate web to a cutter assembly;

means for providing a conveyed flow of products having a preselected spacing pattern including a gap between a grouping of said products;

means for monitoring said conveyed flow of products and for signaling said cutter assembly to sever the substrate web to a pre-cut substrate length defined by severance gaps and to provide the pre-cut substrate length to a substrate supply assembly in timed sequence with said conveyed product flow means;

means for operatively intersecting said substrate supply assembly and said conveyed product flow means, said timed sequence being such that said grouping of products from the conveyed product flow means is deposited onto said pre-cut substrate length and such that said gap of the preselected spacing pattern generally coincides with one of said severance gaps, thereby forming a sheet product.

13. The sheet product forming apparatus according to claim 12, further including a drive assembly that synchronously drives said conveyed product flow means, said substrate supply assembly and switch means for providing a gap signal when said means for providing products defines said gap, wherein said monitoring means provides a product coming signal in response to the presence of said products on the conveyed product flow means, and wherein said gap signal and said product coming signal combine to command said providing of the pre-cut substrate length in timed sequence with said conveyed product flow means.

14. The sheet product forming apparatus according to claim 13, wherein said means for providing a conveyed flow of products includes a slicer assembly having drive means for slicing a bulk product into said conveyed flow of products and for driving said drive assembly.

15. The sheet product forming apparatus according to claim 12, wherein said cutter assembly includes a rotating cutting edge that moves to a severing orientation while same is rotating.

16. An apparatus for automatically forming and stacking sheet products, comprising:

means for feeding a substrate web to a cutter assembly;

means for providing a conveyed flow of products having a preselected spacing patern including a gap between a grouping of said products;

means for monitoring said conveyed flow of products and for signaling said cutter assembly to sever the substrate web to a pre-cut substrate length defined by severance gaps and to provide the pre-cut substrate length to a substrate supply assembly in timed sequence with said conveyed product flow means;

an intersection at which said substrate supply assembly operatively intersects with said conveyed product flow means, and said timed sequence being such that said grouping of products from the conveyed product flow means is deposited onto said pre-cut substrate length and such that said gap of the preselected spacing pattern generally coincides with one of said severance gaps, thereby forming a flow of sheet products; and means for stacking the flow of sheet product into a stack of a plurality of sheet products.

17. A method for automatically forming and stacking sheet products, comprising:

feeding a substrate web to a web cutting location;

providing a conveyed flow of products having a preselected spacing pattern including a gap between a grouping of said products;

monitoring said conveyed flow of products and signaling severance of the substrate web to a pre-cut substrate length defined by severance gaps;

providing the pre-cut substrate length to a substrate supply assembly in timed sequence with the conveyed flow of products;

operatively intersecting the pre-cut substrate with the conveyed flow of products, said timed sequence being such that said grouping of products is deposited onto the pre-cut substrate length and such that the gap between the grouping of products generally coincides with one of the severance gaps, thereby forming a sheet product;

conveying a flow of said sheet products for reducing the rate of flow thereof; and stacking the reduced rate flow of sheet products into a stack of a plurality of sheet products.

18. The method according to claim 17, wherein said monitoring step includes providing a signal for initiating said step of stacking the reduced rate flow of sheet products.

19. The method according to claim 17, wherein said step of conveying the flow of sheet products for reducing the rate of flow thereof includes providing a flow of intermediate product stacks of two product stacks, said flow of intermediate product stacks having a spacing between intermediate product stacks that is greater than spacing between product stacks prior to this reducing step.

20. The method according to claim 17, wherein said stacking step includes lifting the reduced flow of sheet products.

21. The method according to claim 18, wherein said monitoring step includes transmitting a signal needed for initiating said lifting step.

22. The method according to claim 20, wherein said stacking step includes laterally oscillating a comb assembly under a sheet product lifted by said lifting step.

23. A method for automatically forming sheet products, comprising:

feeding a substrate web to a web cutting location;

providing a conveyed flow of products having a preselected spacing pattern including a gap between a grouping of said products;

monitoring said conveyed flow of products and signaling severance of the substrate web to a pre-cut substrate length defined by severance gaps;

providing the pre-cut substrate length to a substrate supply assembly in timed sequence with the conveyed flow of products; and operatively intersecting the pre-cut substrate with the conveyed flow of products, said timed sequence being such that said grouping of products is deposited onto the pre-cut substrate length and such that the gap between the grouping of products generally coincides with one of the severance gaps, thereby forming a sheet product.

24. A method for automatically forming and stacking sheet products, comprising:

feeding a substrate web to a web cutting location;

providing a conveyed flow of products having a preselected spacing pattern including a gap between a grouping of said products;

monitoring said conveyed flow of products and signaling severance of the substrate web to a pre-cut substrate length defined by severance gaps;

providing the pre-cut substrate length to a substrate supply assembly in timed sequence with the conveyed flow of products;

operatively intersecting the pre-cut substrate with the conveyed flow of products, said timed sequence being such that said grouping of products is deposited onto the pre-cut substrate length and such that the gap between the grouping of products generally conicides with one of the severance gaps, thereby forming a flow of sheet products; and stacking the flow of sheet products into a stack of a plurality of sheet products.

25. The method according to claim 24, wherein said monitoring step includes providing a signal for initiating said step of stacking the flow of sheet products.

26. The method according to claim 24, wherein said stacking step includes lifting the flow of sheet products.

27. The method according to claim 25, wherein said monitoring step includes transmitting a signal needed for initiating said lifting step.

28. The method according to claim 26, wherein said stacking step includes laterally oscillating a comb assembly under a sheet product lifted by said lifting step.

* * * * *

US004532751B1

REEXAMINATION CERTIFICATE (3433rd)

United States Patent [19] [11] B1 4,532,751

Mally et al. [45] Certificate Issued Feb. 3, 1998

[54] AUTOMATIC SHEET PRODUCT LINE

[75] Inventors: Timothy G. Mally, Oregon; James A. Rattmann, Sun Prairie; Alvin Borsuk, Madison, all of Wis.

[73] Assignee: Oscar Mayer Foods Corp., Madison, Wis.

Reexamination Request:
No. 90/003,185, Sep. 10, 1993

Reexamination Certificate for:

| | |
|---|---|
| Patent No.: | **4,532,751** |
| Issued: | **Aug. 6, 1985** |
| Appl. No.: | **600,702** |
| Filed: | **Apr. 16, 1984** |

[51] Int. Cl.[6] ..... B26D 5/00; B26D 7/28; B65B 25/08; B65B 35/44

[52] U.S. Cl. ..... 53/396; 53/73; 53/74; 53/389.3; 53/435; 53/517; 53/397; 53/53; 53/58; 53/66; 53/500; 53/501; 53/531; 83/205; 83/285; 83/23

[58] Field of Search ..... 53/541, 397, 53, 53/54, 58, 500, 501, 531, 580, 244, 251, 389.3

[56] References Cited

U.S. PATENT DOCUMENTS

| | | | |
|---|---|---|---|
| 1,957,623 | 5/1934 | Walter . | |
| 1,985,547 | 12/1934 | Quick . | |
| 1,998,572 | 4/1935 | Dewsberry . | |
| 2,006,091 | 6/1935 | Walter . | |
| 2,038,864 | 4/1936 | Walter . | |
| 2,073,082 | 3/1937 | Walter . | |
| 2,156,454 | 5/1939 | Harless . | |
| 2,172,364 | 9/1939 | Manna . | |
| 2,227,683 | 1/1941 | Walter . | |
| 2,397,044 | 3/1946 | Rapley . | |
| 2,744,553 | 5/1956 | Folk . | |
| 2,845,763 | 8/1958 | Wonsidler . | |
| 2,937,482 | 5/1960 | Lazott et al. | 53/541 X |
| 3,015,350 | 1/1962 | Reichel et al. . | |
| 3,080,043 | 3/1963 | Johansen et al. . | |
| 3,107,709 | 10/1963 | Garapolo et al. . | |
| 3,154,307 | 10/1964 | Williamson . | |
| 3,296,768 | 1/1967 | Lotz et al. . | |
| 3,382,965 | 5/1968 | Pierce, Jr. et al. . | |
| 3,513,625 | 5/1970 | Eller et al. . | |
| 3,530,972 | 9/1970 | Erekson . | |

(List continued on next page.)

FOREIGN PATENT DOCUMENTS

| | | |
|---|---|---|
| 1334637 | 11/1963 | France . |
| 355162 | 8/1961 | Switzerland . |

OTHER PUBLICATIONS

Dec. 1981 Control Process, Inc. product literature for Interstack 250.

*Meat Industry* magazine, Jul. 1982, p. 87 and May 1983, p. 71.

*MP* (Meat Processing) magazine, Sep. 11, 1982, p. 73.

*Western Meat Industry* magazine, Mar. 1962, p. 18.

Processomatic Price List, May 10, 1977 and Jan. 10, 1978 (one sheet each).

Processomatic Speedline 1000 product sheets, Sep. 3, 1982, (two sheets—two sides each).

*ANCO/mepaco Meat Processing Equipment* catalog, Chemetron Food/Process Systems 1975 (72 pages plus covers).

(Control Process, Inc. advertisement, "Meat Industry" magazine, Oct. 1981 issue, p. 37.)

(Control Process, In. advertisement, "Meat Industry" magazine, Jan. 1982 issue, p. 51.)

*Primary Examiner*—Horace M. Culver

[57] ABSTRACT

A product line is provided for forming a sheet product composed of products such as bacon slices resting on a pre-cut thin substrate such as a sheet of paper. The substrate sheets are pre-cut to a predetermined length, and a flow of individual products and a flow of pre-cut sheets are coordinated such that the products deposit onto the pre-cut sheets in a predetermined pattern. The line may also include an assembly for reducing the flow rate of the thus formed sheet products, after which the reduced flow is conveyed to a stacking assembly for forming stacks of sheet products of a preselected size.

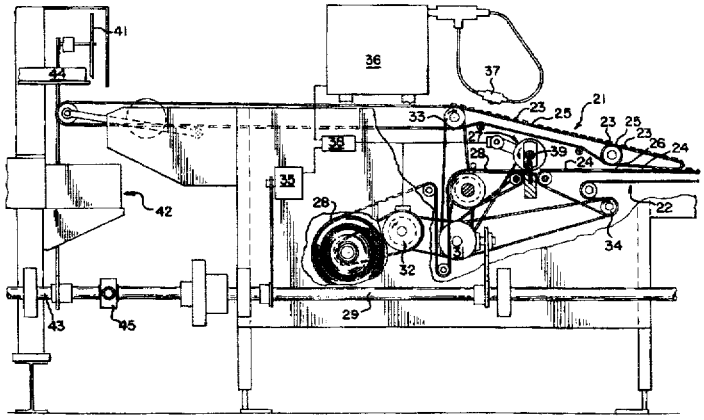

U.S. PATENT DOCUMENTS 3,846,958 11/1974 Divan .
3,910,141 10/1975 Divan .
3,943,684 3/1976 Lotz .
3,971,481 7/1976 Longenecker et al. .
4,026,421 5/1977 Lotz .
4,065,911 1/1978 Fagan .
4,083,277 4/1978 Lotz .
4,129,053 12/1978 Kent .
4,236,855 12/1980 Wagner et al. .
4,284,187 8/1981 Kramer et al. .
4,307,800 12/1981 Joa .
4,450,949 5/1984 Buschor et al. .
4,875,326 10/1989 Piano ..... 53/541 X

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–11 is confirmed.

Claims 17, 20, 23, 24 and 26 are cancelled.

Claims 12, 16, 18, 19, 22, 25 and 28 are determined to be patentable as amended.

Claims 13, 14, 15, 21 and 27, dependent on an amended claim, are determined to be patentable.

12. An apparatus for automatically forming sheet products, comprising:

means for feeding a substrate web to a cutter assembly;

means for providing a conveyed flow of products *consisting of thin, flexible slices* having a preselected spacing pattern including a gap between a grouping of said products;

means for monitoring said conveyed flow of products and for signaling said cutter assembly to sever the substrate web to a pre-cut substrate length defined by severance gaps and to provide the pre-cut substrate length to a substrate supply assembly in timed sequence with said conveyed product flow means;

means for operatively intersecting said substrate supply assembly and said conveyed product flow means, said timed sequence being such that said grouping of products from the conveyed product flow means is deposited onto said pre-cut substrate length and such that said gap of the preselected spacing pattern generally coincides with one of said severance gaps, thereby forming a sheet product.

16. An apparatus for automatically forming and stacking sheet products, comprising:

means for feeding a substrate web to a cutter assembly;

means for providing a conveyed flow of products *consisting of thin, flexible slices* having a preselected spacing patern including a gap between a grouping of said products;

means for monitoring said conveyed flow of products and for signaling said cutter assembly to sever the substrate web to a pre-cut substrate length defined by severance gaps and to provide the pre-cut substrate length to a substrate supply assembly in timed sequence with said conveyed product flow means;

an intersection at which said substrate supply assembly operatively intersects with said conveyed product flow means, and said timed sequence being such that said grouping of products from the conveyed product flow means is deposited onto said pre-cut substrate length and such that said gap of the preselected spacing pattern generally coincides with one of said severance gaps, thereby forming a flow of sheet products; and means for stacking the flow of sheet product into a stack of a plurality of sheet products.

18. [The method according to claim 17,] *A method for automatically forming and stacking sheet products, comprising:*

*feeding a substrate web to a web cutting location;*

*providing a conveyed flow of products having a preselected spacing pattern including a gap between a grouping of said products;*

*monitoring said conveyed flow of products and signaling severance of the substrate web to a pre-cut substrate length defined by severance gaps;*

*providing the pre-cut substrate length to a substrate supply assembly in timed sequence with the conveyed flow of products;*

*operatively intersecting the pre-cut substrate with the conveyed flow of products, said timed sequence being such that said grouping of products is deposited onto the pre-cut substrate length and such that the gap between the grouping of products generally coincides with one of the severance gaps, thereby forming a sheet product;*

*conveying a flow of said sheet products from said intersection of said pre-cut substrate with said conveyed flow of products;*

*reducing the rate of flow of said flow of sheet products; and*

*stacking the reduced rate flow of sheet products into a stack of a plurality of sheet products;* wherein said monitoring step includes providing a signal for initiating said step of stacking the reduced rate flow of sheet products.

19. [The method according to claim 17,] *A method for automatically forming and stacking sheet products, comprising:*

*feeding a substrate web to a web cutting location;*

*providing a conveyed flow of products having a preselected spacing pattern including a gap between a grouping of said products;*

*monitoring said conveyed flow of products and signaling severance of the substrate web to a pre-cut substrate length defined by severance gaps;*

*providing the pre-cut substrate length to a substrate supply assembly in timed sequence with the conveyed flow of products;*

*operatively intersecting the pre-cut substrate with the conveyed flow of products, said timed sequence being such that said grouping of products is deposited onto the pre-cut substrate length and such that the gap between the grouping of products generally coincides with one of the severance gaps, thereby forming a sheet product;*

*conveying a flow of said sheet products from said intersection of said pre-cut substrate with said conveyed flow of products;*

*reducing the rate of flow of said flow of sheet products; and*

*stacking the reduced rate flow of sheet products into a stack of a plurality of sheet products;* wherein said step of conveying the flow of sheet products for reducing the rate of flow thereof includes providing a flow of intermediate product stacks of two product stacks, said flow of intermediate product stacks having a spacing between intermediate product stacks that is greater than spacing between product stacks prior to this reducing step.

22. [The method according to claim 20,] *A method for automatically forming and stacking sheet products, comprising:*

*feeding a substrate web to a web cutting location;*

*providing a conveyed flow of products having a preselected spacing pattern including a gap between a grouping of said products;*

*monitoring said conveyed flow of products and signaling severance of the substrate web to a pre-cut substrate length defined by severance gaps;*

*providing the pre-cut substrate length to a substrate supply assembly in timed sequence with the conveyed flow of products;*

*operatively intersecting the pre-cut substrate with the conveyed flow of products, said timed sequence being such that said grouping of products is deposited onto the pre-cut substrate length and such that the gap between the grouping of products generally coincides with one of the severance gaps, thereby forming a sheet product;*

*conveying a flow of said sheet products from said intersection of said pre-cut substrate with said conveyed flow of products;*

*reducing the rate of flow of said flow of sheet products; and*

*stacking the reduced rate flow of sheet products into a stack of a plurality of sheet products;*

*wherein said stacking step includes lifting the reduced flow of sheet products and* wherein said stacking step *further* includes laterally oscillating a comb assembly under a sheet product lifted by said lifting step.

25. [The method according to claim 24.] *A method for automatically forming and stacking sheet products, comprising:*

*feeding a substrate web to a web cutting location;*

*providing a conveyed flow of products consisting of thin, flexible slices having a preselected spacing pattern including a gap between a grouping of said products;*

*monitoring said conveyed flow of products and signaling severance of the substrate web to a pre-cut substrate length defined by severance gaps;*

*providing the pre-cut substrate length to a substrate supply assembly in timed sequence with the conveyed flow of products;*

*operatively intersecting the pre-cut substrate with the conveyed flow of products, said timed sequence being such that said grouping of products is deposited onto the pre-cut substrate length and such that the gap between the grouping of products generally coincides with one of the severance gaps, thereby forming a flow of sheet products; and*

*stacking the flow of sheet products into a stack of a plurality of sheet products;* wherein said monitoring step includes providing a signal for initiating said step of stacking the flow of sheet products.

28. [The method according to claim 26.] *A method for automatically forming and stacking sheet products, comprising:*

*feeding a substrate web to a web cutting location;*

*providing a conveyed flow of products consisting of thin, flexible slices having a preselected spacing pattern including a gap between a grouping of said products;*

*monitoring said conveyed flow of products and signaling severance of the substrate web to a pre-cut substrate length defined by severance gaps;*

*providing the pre-cut substrate length to a substrate supply assembly in timed sequence with the conveyed flow of products;*

*operatively intersecting the pre-cut substrate with the conveyed flow of products, said timed sequence being such that said grouping of products is deposited onto the pre-cut substrate length and such that the gap between the grouping of products generally coincides with one of the severance gaps, thereby forming a flow of sheet products; and*

*stacking the flow of sheet products into a stack of a plurality of sheet products;*

*wherein said stacking step includes lifting the flow of sheet products and* wherein said stacking step *further* includes laterally oscillating a comb assembly under a sheet product lifted by said lifting step.

* * * * *